US011248330B2

(12) United States Patent
Kim

(10) Patent No.: US 11,248,330 B2
(45) Date of Patent: Feb. 15, 2022

(54) WASHING MACHINE

(71) Applicant: SAMSUNG ELECTRONICS CO., LTD., Suwon-si (KR)

(72) Inventor: Jin Doo Kim, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 49 days.

(21) Appl. No.: 16/487,592

(22) PCT Filed: Dec. 11, 2017

(86) PCT No.: PCT/KR2017/014445
§ 371 (c)(1),
(2) Date: Aug. 21, 2019

(87) PCT Pub. No.: WO2018/155797
PCT Pub. Date: Aug. 30, 2018

(65) Prior Publication Data

US 2020/0024786 A1 Jan. 23, 2020

(30) Foreign Application Priority Data

Feb. 23, 2017 (KR) ..... 10-2017-0024126

(51) Int. Cl.
*D06F 37/28* (2006.01)
*D06F 37/18* (2006.01)
(Continued)

(52) U.S. Cl.
CPC ..... *D06F 37/28* (2013.01); *D06F 37/18* (2013.01); *D06F 37/42* (2013.01); *D06F 37/10* (2013.01); *D06F 39/14* (2013.01)

(58) Field of Classification Search
CPC ..... D06F 37/28; D06F 37/18; D06F 39/14
See application file for complete search history.

(56) References Cited

U.S. PATENT DOCUMENTS 2,306,232 A * 12/1942 Smith ..... D06F 39/14 68/196
2004/0020246 A1* 2/2004 Yun ..... D06F 39/14 68/24

(Continued)

FOREIGN PATENT DOCUMENTS

EP 0 731 204 A1 9/1996
EP 3 115 494 A1 1/2017

(Continued)

OTHER PUBLICATIONS

Extended European Search Report dated Oct. 21, 2019 from European Patent Application No. 17897876.3, 6 pages.

(Continued)

*Primary Examiner* — Spencer E. Bell
(74) *Attorney, Agent, or Firm* — Staas & Halsey, LLP

(57) ABSTRACT

A washing machine is disclosed. The disclosed washing machine includes a housing, a tub disposed inside the housing and including a laundry loading port, and a door configured to open and close the laundry loading port, wherein the door includes a water collecting space provided to collect water flowing along one surface of the door when the laundry loading port is opened, and a water collecting cover portion provided to cover at least a portion of the water collecting space.

12 Claims, 12 Drawing Sheets

(51) Int. Cl.

| | |
|---|---|
| ***D06F 39/14*** | (2006.01) |
| ***D06F 37/42*** | (2006.01) |
| *D06F 37/10* | (2006.01) |

(56) References Cited

U.S. PATENT DOCUMENTS

| | | | | |
|---|---|---|---|---|
| 2011/0131735 | A1 | 6/2011 | Park et al. | |
| 2015/0275413 | A1* | 10/2015 | Kim | D06F 29/00 68/27 |
| 2017/0306550 | A1* | 10/2017 | Harbrecht | D06F 39/14 |
| 2020/0232137 | A1* | 7/2020 | Zhao | D06F 39/083 |

FOREIGN PATENT DOCUMENTS

| | | |
|---|---|---|
| KR | 10-2005-0114337 | 12/2005 |
| KR | 10-2008-0109488 | 12/2008 |
| KR | 10-2015-0137663 | 12/2015 |
| KR | 10-2017-0019849 | 2/2017 |

OTHER PUBLICATIONS

European Communication dated Jul. 8, 2020 from European Application No. 17897876.3, 4 pages.
International Search Report dated Mar. 29, 2018 in International Patent Application No. PCT/KR2017/014445, 5 pages.
Written Opinion of the International Searching Authority dated Mar. 29, 2018 in International Patent Application No. PCT/KR2017/014445, 4 pages.

* cited by examiner

WASHING MACHINE

CROSS-REFERENCE TO RELATED APPLICATIONS

This application is a U.S. National Stage Application which claims the benefit under 35 U.S.C. § 371 of International Patent Application No. PCT/KR2017/014445 filed on Dec. 11, 2017, which claims foreign priority benefit under 35 U.S.C. § 119 of Korean Patent Application No. 10-2017-0024126 filed on Feb. 23, 2017 in the Korean Intellectual Property Office, the contents of both of which are incorporated herein by reference.

TECHNICAL FIELD

The present disclosure relates to a washing machine, and more particularly, to a washing machine including a laundry loading port disposed on an upper portion thereof.

BACKGROUND ART

Generally, a washing machine is a device for washing a laundry by rotating a cylindrical drum containing laundry. As a type of washing machine, there are a washing machine in which laundry is washed by falling down after being lifted upward along an inner circumferential surface of a drum as the drum, which is disposed substantially horizontally, rotates with respect to a horizontal axis and a washing machine in which laundry is washed using a water current generated by a pulsator disposed inside a drum when the drum disposed substantially vertically rotates with respect to a vertical axis.

The washing machine in which the drum is horizontally disposed is called a front loading type washing machine because a laundry loading port is formed on the front portion of the washing machine, and the washing machine in which the drum is vertically disposed is called a top loading type washing machine because the laundry loading port is formed on the upper portion.

In the top loading washing machine, laundry after dehydration is wetted again because when a door is opened after washing is completed, washing water remaining on the inner surface of the door may flow in the direction of gravity along the inner surface of the door and fall into the inside of a tub.

DISCLOSURE

Technical Problem

The present disclosure is directed to providing a washing machine capable of preventing laundry that has been laundered from being wetted again.

Further, the present disclosure is directed to providing a washing machine including a door capable of collecting washing water remaining on the door when the door is opened after washing is completed.

Further, the present disclosure is directed to providing a washing machine capable of preventing washing water collected from being exposed to a user when a door is opened.

Further, the present disclosure is directed to providing a washing machine capable of simply discharging washing water collected in a door.

Further, the present disclosure is directed to providing a washing machine including a door with an improved structure.

Technical Solution

One aspect of the present disclosure provides a washing machine including a housing, a tub disposed inside the housing and including a laundry loading port, and a door configured to open and close the laundry loading port, wherein the door includes a water collecting space provided to collect water flowing along one surface of the door when the laundry loading port is opened, and a water collecting cover portion provided to cover at least a portion of the water collecting space.

The door may include a door cover and a cover holder on which the door cover is mounted and including the water collecting cover portion, and a portion of the door cover may be spaced apart from the water collecting cover portion by a predetermined distance to form an inflow gap so that the water flows into the water collecting space.

The water collecting cover portion may include a drain hole formed to discharge the water collected in the water collecting space from the water collecting space when the door closes the laundry loading port.

The drain hole may be disposed in the front of the water collecting space when the door closes the laundry loading port.

The door cover may be configured to include a material having transparency.

The cover holder may include a door opening formed such that the inside of the tub is seen when the door closes the laundry loading port, and the water collecting cover portion may be disposed at at least a portion of the door opening along a circumference of the door opening.

The door may further include a first sealing member to seal a gap between the door cover and the cover holder, and the cover holder may include an insertion portion into which at least a portion of the first sealing member is inserted.

The water collecting space may be formed in the insertion portion.

The insertion portion may include a first fixing portion to fix the first sealing member, and the first sealing member may include a first insertion groove inserted into the first fixing portion.

The other side surface different from one side surface of the first sealing member formed with the first insertion groove may be fixed to the door cover.

The water collecting cover portion may protrude from one surface of the door directing to the laundry loading port when the door closes the laundry loading port.

The door may be rotatably mounted on the tub, and the water collecting space may be disposed at one side end portion adjacent to a pivot axis of the door.

The door may further include a second sealing member to seal a gap between the tub and the door.

The water collecting space may be disposed at a lower end portion of the door when the door opens the laundry loading port.

The washing machine may further include a lid rotatably provided in the housing, wherein the housing may include a housing opening formed in a direction to which the laundry loading port directs, and the lid may open and close the housing opening.

Another aspect of the present disclosure provides a washing machine including a housing including a housing opening, a tub disposed in the housing opening, and a door opening and closing the housing opening, wherein the door includes a door cover, a cover holder on which the door cover is mounted and including a water collecting cover portion disposed to be spaced apart from the door cover by a predetermined distance, and a water collecting space provided in the cover holder to collect water flowing along the door cover when the door opens the laundry loading port.

The door may include an inflow gap disposed between the door cover and the water collecting cover portion to guide water to the water collecting space, and a drain hole formed on the water collecting cover portion to guide the water from the water collecting space to the inside of the tub.

The door may include a first sealing member configured to seal a gap between the door cover and the cover holder and a portion of which is disposed in the water collecting space.

The water collecting cover portion may be disposed to cover the front of the water collecting space when the door opens the housing opening.

Another aspect of the present disclosure provides a washing machine including a first housing, a second housing provided on an upper portion of the first housing, a first tub covered by the first housing and including a first laundry loading port disposed in the front thereof, a second tub covered by the second housing and including a second laundry loading port disposed on an upper portion thereof, and a door configured to open and close the second laundry loading port, wherein the door includes a water collecting space provided to collect water flowing along an inner side surface of the door when the door opens the second laundry loading port, a water collecting cover portion provided to cover the water collecting space, and a drain hole provided to discharge water in the water collecting space when the door closes the second laundry loading port.

Advantageous Effects

A washing machine according to the idea of the present disclosure can prevent laundry from being wet again as the remaining washing water drops to the laundry when a door is opened after the completion of washing because the washing machine is provided with a water collecting structure capable of collecting the washing water remaining on an inner side surface of the door.

The washing machine according to the idea of the present disclosure can prevent the collected water from being exposed to a user when the door is opened because the washing machine is provided with a water collecting cover portion in the door to cover a water collecting space.

The washing machine according to the idea of the present disclosure can discharge the water collected in the water collecting space to a washing space only with an operation closing the door because a drain hole is provided in the water collecting cover portion.

The washing machine according to the idea of the present disclosure can have a neat appearance because a first sealing member for sealing a gap between a door cover and a cover holder is inserted into an insertion portion provided in the cover holder.

MODE OF THE INVENTION

Figure 1:
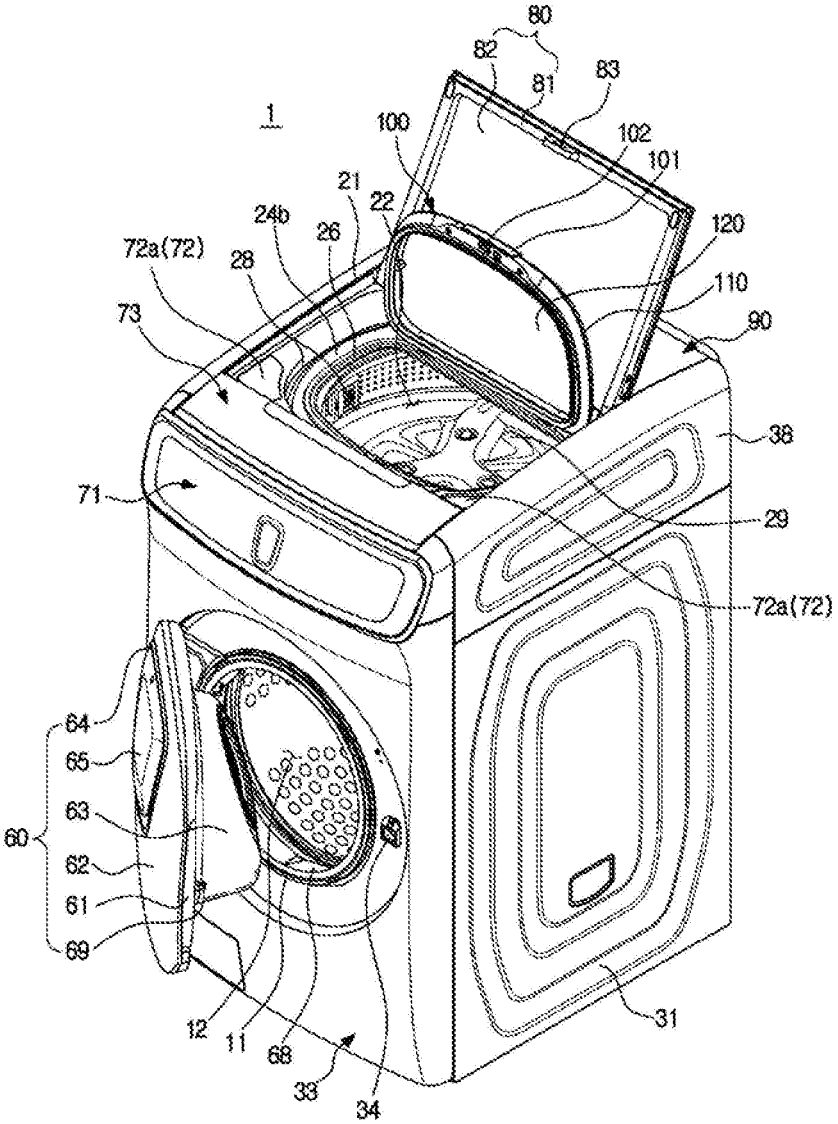
FIG. 1 is a perspective view of a washing machine according to an embodiment of the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numerals or signs in the respective drawings of the present specification represent parts or components that perform substantially the same functions.

The terms used in the present specification are for the purpose of describing the embodiments and are not intended to restrict and/or to limit the present disclosure. For example, the singular expressions herein may include plural expressions, unless the context clearly dictates otherwise. Also, the terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

The terms "front end," "rear end," "upper portion," "lower portion," "upper end" and "lower end" used in the following description are defined with reference to the drawings, and the shape and position of each component are not limited by these terms.

Hereinafter, embodiments of the present disclosure will be described in detail with reference to the accompanying drawings.

Figure 2:
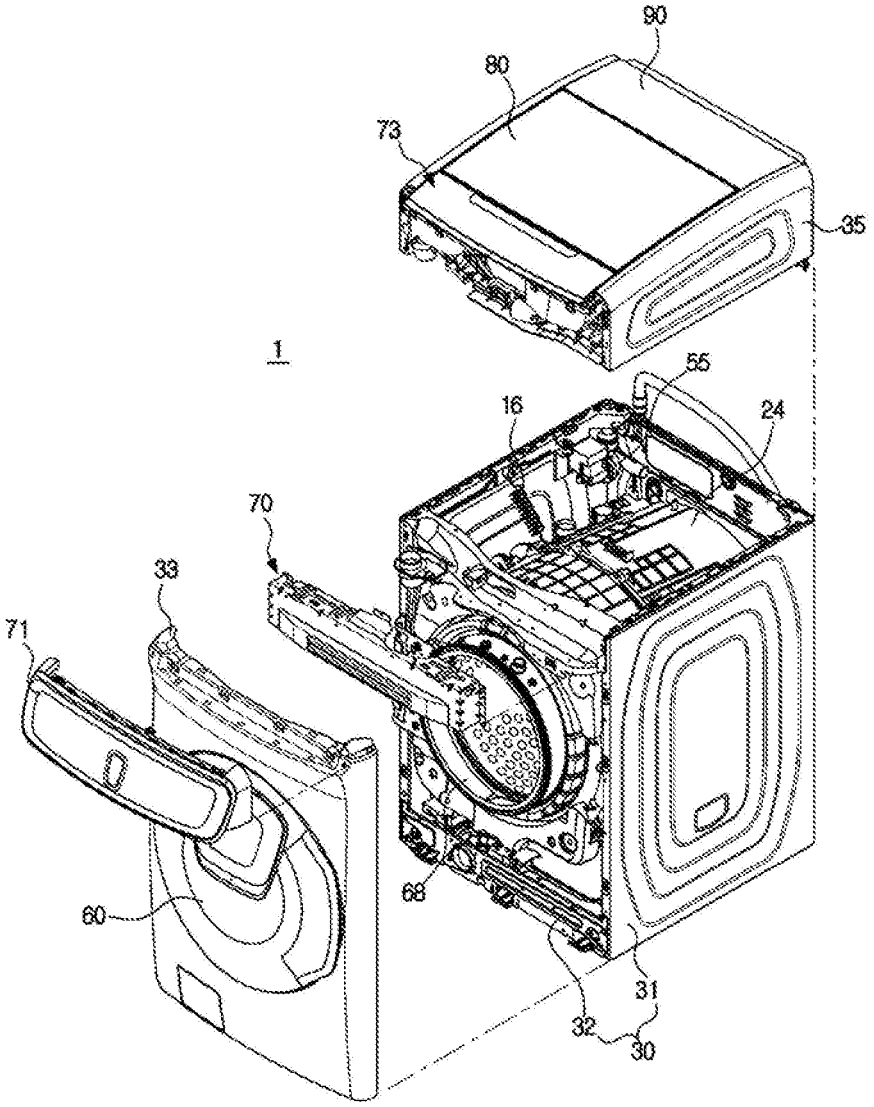
FIG. 2 is a view separately illustrating a first washing apparatus and a second washing apparatus of the washing machine illustrated in FIG. 1.
Figure 3:
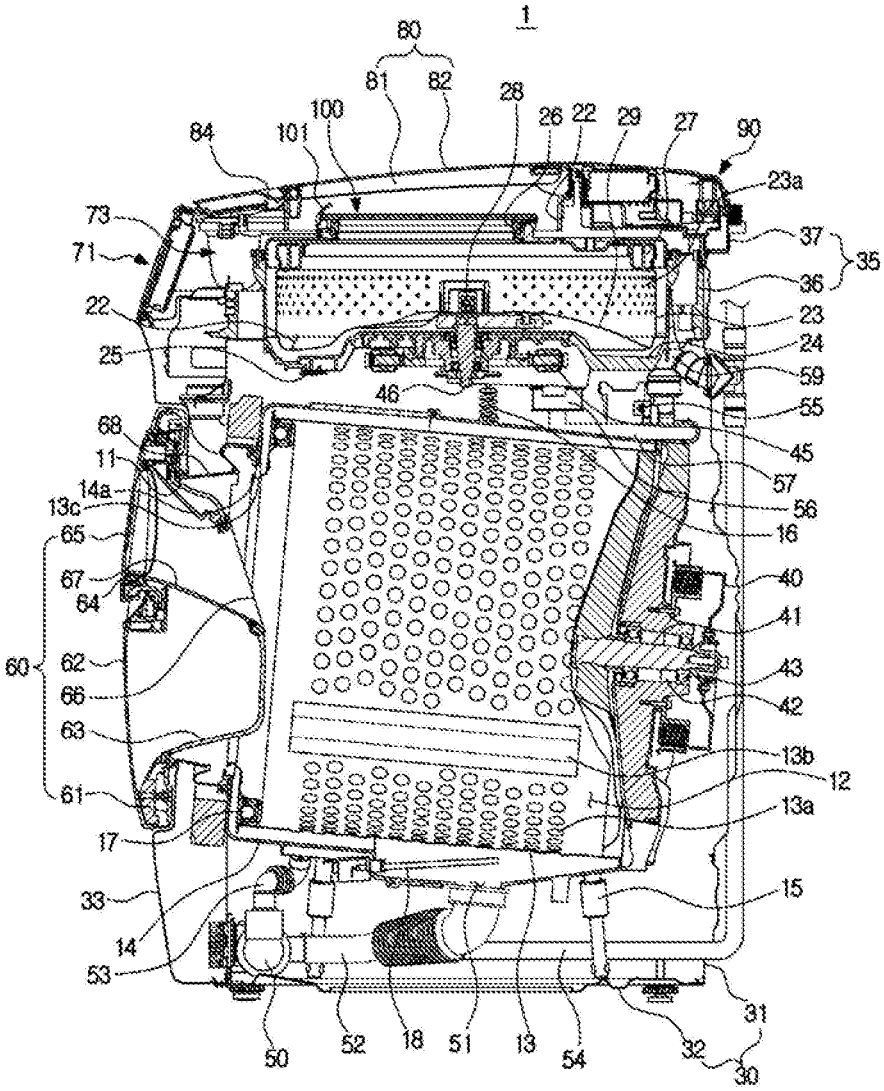
FIG. 3 is a cross-sectional view of the washing machine illustrated in FIG. 1.

FIG. 1 is a perspective view of a washing machine 1 according to an embodiment of the present disclosure. FIG. 2 is a view separately illustrating a first washing apparatus 10 and a second washing apparatus 20 of the washing machine 1 illustrated in FIG. 1. FIG. 3 is a cross-sectional view of the washing machine 1 illustrated in FIG. 1.

As illustrated in FIGS. 1 and 2, the washing machine 1 may include the first washing apparatus 10 of a front loading type in which a first laundry loading port 11 is formed at a front side, and the second washing apparatus 20 of a top loading type in which a second laundry loading port 21 is formed in an upper side. The second washing apparatus 20 may be disposed above the first washing apparatus 10.

The first washing apparatus 10 may include a first drum 13 having a first washing space 12 formed therein, and a first tub 14 for housing the first drum 13 therein and storing washing water or rinsing water to be used for a washing or rinsing process. The first drum 13 and the first tub 14 may be provided in a cylindrical shape with at least a portion of one surface being opened, and the opened portion may be disposed to be substantially directed forward.

The first washing apparatus 10 may include a first housing 30. Specifically, the first housing 30 may a side frame 31 forming an outer appearance of side surfaces and a rear surface, and a bottom frame 32 forming a bottom surface.

Also, the first washing apparatus 10 may include a damper 15 and a spring 16 for supporting the first tub 14 with respect to the first housing 30. The damper 15 may support the first tub 14 at a lower side of the first tub 14 by connecting an outer surface of the first tub 14 and the bottom frame 32, and the spring 16 may support the first tub 14 at an upper side of the first tub 14 by connecting an outer surface of the first tub 14 and the side frame 31. The damper 15 and the spring 16 may reduce the vibration, noise, and shock generated by the movement of the first tub 14.

The position of the damper 15 and the spring 16 is not limited to an upper end of the side frame 31 and the bottom frame 32, and the damper 15 and the spring 16 may support the first tub 14 by connecting one surface of the first tub 14 and a portion of the first housing 30 as necessary.

The first washing apparatus 10 may include a first driving motor 40 disposed in the rear of the first tub 14 to rotate the first drum 13. A first driving shaft 41 for transmitting the power of the first driving motor 40 may be connected to a rear surface of the first drum 13.

A plurality of first through holes 13*a* for the flow of washing water may be formed on a circumference of the first drum 13. A plurality of lifters 13*b* may be provided on an inner circumferential surface of the first drum 13 so that laundry may be lifted and dropped when the first drum 13 rotates. A first balancer 17 may be mounted on a front end portion of the first drum 13 to stably rotate the first drum 13 during high-speed rotation.

The first driving shaft 41 may be disposed between the first drum 13 and the first driving motor 40. One end of the first driving shaft 41 may be connected to a rear plate of the first drum 13 and the other end of the first driving shaft 41 may extend outside a rear wall of the first tub 14. When the first driving motor 40 drives the first driving shaft 41, the first drum 13 connected to the first driving shaft 41 rotates around the first driving shaft 41.

A bearing housing 42 may be provided on the rear wall of the first tub 14 to rotatably support the first driving shaft 41. The bearing housing 42 may be made of aluminum alloy and may be inserted into the rear wall of the first tub 14 when the first tub 14 is injection molded. Bearings 43 may be provided between the bearing housing 42 and the first driving shaft 41 to allow the first driving shaft 41 to rotate smoothly.

The first washing apparatus 10 may include a function of washing the laundry with hot water. A heater 18 capable of heating washing water or rinsing water stored in the first tub 14 may be provided on the bottom surface of the first tub 14 in order to obtain hot water.

The first washing apparatus 10 may include a first drain pump 50 disposed below the first tub 14 to discharge the water inside the first tub 14 to the outside of the washing machine 1, a first connection hose 52 for connecting a first drain hole 51 of the first tub 14 and the first drain pump 50 so that water inside the first tub 14 may be introduced into the first drain pump 50, a circulation hose 53 for connecting the first drain pump 50 and the first tub 14 to circulate the water introduced into the first drain pump 50 to the first tub 14, and a first drain hose 54 for guiding the water pumped by the first drain pump 50 to the outside of the washing machine 1.

The washing machine 1 may include a front cover 33 provided with the first laundry loading port 11 through which laundry may be loaded into the first washing space 12 of the first washing apparatus 10. A first door 60 for opening and closing the first laundry loading port 11 may be coupled to the front cover 33.

The first door 60 may be provided to correspond to the first laundry loading port 11 and be rotatable with respect to the front cover 33. The first door 60 may include a first door frame 61, a first door cover 62, and a door glass 63.

In the embodiment of the present disclosure, the first door frame 61 is formed in a substantially annular shape, but it may be formed in a substantially rectangular shape. The first door cover 62 and the door glass 63 may be configured to include a transparent material so that the inside of the first drum 13 may be seen from the outside of the washing machine 1 even when the first door 60 closes the first laundry loading port 11. The door glass 63 may be disposed to convexly protrude from the first door frame 61 toward the inside of the first drum 13. With this configuration, when the first door 60 is closed, the door glass 63 may be inserted into the first laundry loading port 11.

The first door 60 may include a first hinge coupling portion formed on one side of the first door frame 61 to be rotatable with respect to the front cover 33, and the first hinge coupling portion may be coupled to a first hinge provided adjacent to the first laundry loading port 11. A first hook 69 may be provided on the other side of the first door frame 61. A first hook receiving portion 34 is provided on the front cover 33 to correspond to the first hook 69 so that the first door 60 may be maintained in a state of closing the first laundry loading port 11.

In order to allow laundry to be loaded into the first washing space 12 even in a closed state, the first door 60 may include an auxiliary laundry loading port 64 and an auxiliary door 65 for opening and closing the auxiliary laundry loading port 64. The auxiliary door 65 may be rotatably mounted on the first door cover 62.

In order to load laundry into the washing machine 1 through the auxiliary laundry loading port 64 of the first door 60, the laundry needs to pass through the door glass 63. To this end, a glass through hole 66 may be formed on the door glass 63. Alternatively, an upper portion of the door glass 63 may be recessed such that the door glass 63 is not disposed in the rear of the auxiliary laundry loading port 64.

In order to connect the auxiliary laundry loading port 64 of the first door 60 and the glass through hole 66 of the door glass 63, the first door 60 includes a connection guide portion 67. The connection guide portion 67 may be provided in the shape of a hollow tube having opposite ends opened.

Specifically, one end of the connection guide portion 67 may be connected to the auxiliary laundry loading port 64, and the other end may be connected to the glass through hole 66. In this embodiment, the connection guide portion 67 may be provided to be inclined downwardly from the front to the rear. That is, one end of the connection guide portion 67 connected to the auxiliary laundry loading port 64 may be located at a higher position than the other end. According to this configuration, a user may easily load laundry into the first drum 13 through the auxiliary laundry loading port 64.

The present embodiment illustrates that the auxiliary door 65 is provided in the first door 60, but the present disclosure is not limited thereto, and the first door 60 may be configured without the auxiliary laundry loading port 64, the auxiliary door 65, the connection guide portion 67, and the like.

The first washing apparatus 10 may include a diaphragm 68 disposed between the first laundry loading port 11 of the front cover 33 and a first opening 14*a* of the first tub 14. The diaphragm 68 forms a passage from the first laundry loading port to the first opening 14*a* of the first tub 14, and may reduce the vibration transmitted to the front cover 33 when the first drum 13 rotates. In addition, a portion of the diaphragm 68 may be disposed between the first door 60 and the front cover 33 to prevent the washing water in the first tub 14 from leaking to the outside of the washing machine 1.

The second washing apparatus 20 may include a second drum 23 having a second washing space 22 formed therein, and a second tub 24 for housing the second drum 23 therein and storing washing water or rinsing water to be used for the washing or rinsing process. The second drum 23 and the second tub 24 may be provided in a cylindrical shape with at least a portion of one surface being opened, and the opened portion may be disposed to be substantially directed forward.

The second washing apparatus 20 may include a second housing 35. Specifically, the second housing 35 may include a lower frame 36 on which the second tub 24 is supported, and an upper frame 37 provided with a second laundry loading port 21 for allowing laundry to be loaded into the second washing space 22 and seated on an upper portion of the lower frame 36. The second laundry loading port 21 may be formed in a direction to which a second opening 26 of the second tub 24, which will be described later, directs.

A side cover 38 may simplify the side surfaces of the second housing 35 by covering the left side surface and the right side surface of the lower frame 36 and upper frame 37 with one member, and may prevent the lower frame 36 and the upper frame 37 from being arbitrarily separated when the lower frame 36 and the upper frame 37 are disassembled by vibration or the like, thereby preventing injury to the user. In addition, the side cover 38 may be formed such that the first housing 30 of the first washing apparatus 10 and the second housing 35 of the second washing apparatus 20 have unified feel when the second washing apparatus 20 is coupled to the first washing apparatus 10.

The second washing apparatus 20 may include a lid 80 for opening and closing the second laundry loading port 21. The lid 80 may be provided to correspond to the second laundry loading port 21 and be rotatable with respect to the upper frame 37. The lid 80 may include a lid handle 84 provided to allow the user to grasp the lid 80 to rotate the lid 80. The lid handle 84 may be provided at one end opposite to a pivot axis of the lid 80.

The lid 80 may include a lid frame 81 and a lid cover 82. The lid cover 82 may be configured to include a transparent material so that the second tub 24 and the second drum 23 may be seen from the outside of the washing machine 1 even when the lid 80 closes the second laundry loading port 21.

A second hinge (not shown) may be provided on both left and right sides of the lid frame 81 so that the lid 80 may rotate with respect to the upper frame 37. The second hinge may be coupled to a second hinge coupling portion (not shown) formed around the second laundry loading port 21. A latch receiving portion 83 may be provided at a front end portion of the lid frame 81, and the upper frame 37 may be provided with a latch device corresponding to the latch receiving portion 83 of the lid frame 81. According to this configuration, the lid 80 of the washing machine 1 according to the embodiment of the present disclosure may be maintained in a state of closing the second laundry loading port 21 when the second washing apparatus 20 is operated.

The second drum 23 may be provided in a cylindrical shape having an opened top surface and may be disposed to be rotatable inside the second tub 24. A plurality of second through holes 23*a* for the flow of washing water may be formed on the side surfaces and the bottom surface of the second drum 23. A second balancer 27 may be mounted on an upper portion of the second drum 23 to stably rotate the second drum 23 during high-speed rotation. A filter 28 may be attached to the inner surface of the second drum 23 to filter foreign substances that may be generated during washing.

A curved portion 29 for generating a water flow may be formed on the bottom surface of the second drum 23. Although not shown in the drawings, the second washing apparatus 20 may further include a pulsator disposed inside the second drum 23 to generate water flow.

The second tub 24 may be formed in a cylindrical shape and supported on the lower frame 36 by a suspension device 25. Specifically, the second tub 24 may be supported in the form of being suspended on the lower frame 36 by four of the suspension devices 25. The second opening 26 may be formed on the upper surface of the second tub 23 to correspond to the second laundry loading port 21 and a second door 100 may be coupled to the second opening 23 to open and close the second opening 26. The second door 100 may seal the second washing space 22 to prevent leakage of wet steam when washing at a high temperature. A detailed explanation of the second door 100 will be described later.

The second washing apparatus 20 may include a second driving motor 45 disposed outside a lower side of the second tub 24 and rotating the second drum 23. A second driving shaft 46 for transmitting the power of the second driving motor 45 may be connected to the bottom surface of the second drum 23. One end of the second driving shaft 46 may be connected to a bottom plate of the second drum 23 and the other end of the second driving shaft 46 may extend outside a bottom wall of the second tub 24. When the second driving motor 45 drives the second driving shaft 46, the second drum 23 connected to the second driving shaft 46 may rotate around the second driving shaft 46.

Although not shown in the drawing, when a pulsator is disposed on the bottom surface of the second drum 23, the second washing apparatus may further include a power switching device for simultaneously or selectively transmitting a driving force generated from the second driving motor 45 to the second drum 23 and the pulsator.

A second drain pump 55 for discharging the water in the second tub 24 to the outside of the washing machine 1 may be disposed in the first washing apparatus 10. Specifically, the first washing apparatus 10 may include the second drain pump 55 disposed at an upper portion of the first housing 30 and may include a second drain hose 59 for guiding the water pumped by the second drain pump 55 to the outside of the washing machine 1.

A second drain hole 56 for draining water in the second tub 24 may be formed on the bottom surface of the second tub 24, and the second drain hole 56 and the first drain pump 55 may be connected by a second connection hose 57 so that water in the second tub 24 may flow into the second drain pump 55.

The second washing apparatus 20 may include a water supply device 90 for supplying washing water to the second tub 24 and the first tub 14 of the first washing apparatus 10. The water supply device 90 may be disposed in the second housing 35. Specifically, the water supply device 90 may be disposed on the upper frame 37, and preferably disposed in the rear of the second laundry loading port 21.

The second washing apparatus 20 may also include a first detergent supply device 73 for supplying detergent to the first washing apparatus 10. The first detergent supply device 73 may be disposed in the second housing 35. Specifically, the first detergent supply device 73 may be disposed on the upper frame 37, and preferably disposed in the front of the second laundry loading port 21.

The washing machine 1 may include a fixing bracket 70 for coupling the first washing apparatus 10 and the second washing apparatus 20 to prevent the first and second washing apparatuses 10 and 20 from being separated from each other. The fixing bracket 70 may fix the first and second washing apparatuses 10 and 20 at the front surfaces of the first and second washing apparatuses 10 and 20.

The washing machine 1 may include a control panel 71 disposed on an upper portion of the front cover 33 to operate the first washing apparatus 10 and the second washing apparatus 20. The control panel 71 may include an input unit (not shown) for receiving an operation command of the washing machine 1 from a user and a display unit (not shown) for displaying operation information of the washing machine 1.

The second washing apparatus 20 may include a second detergent supply device 72 for storing a fabric softening agent and/or a bleaching agent to be supplied to the second washing space 22. The second detergent supply device 72 may be disposed on the upper frame 37 and may include a detergent box 72*a* having an opening provided to substantially face the upper surface. The second detergent supply device 72 may be provided at the left end and the right end of the front of the second opening 26, respectively. The second detergent supply device 72 may be provided to be accessible by the user as the second door 100 is opened.

Figure 4:
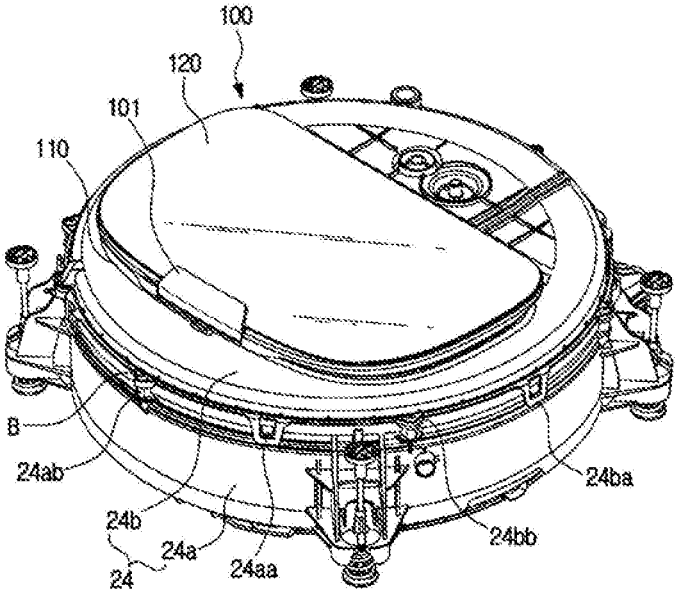
FIG. 4 is a view illustrating a second tub and a second door of the washing machine illustrated in FIG. 1.
Figure 5:
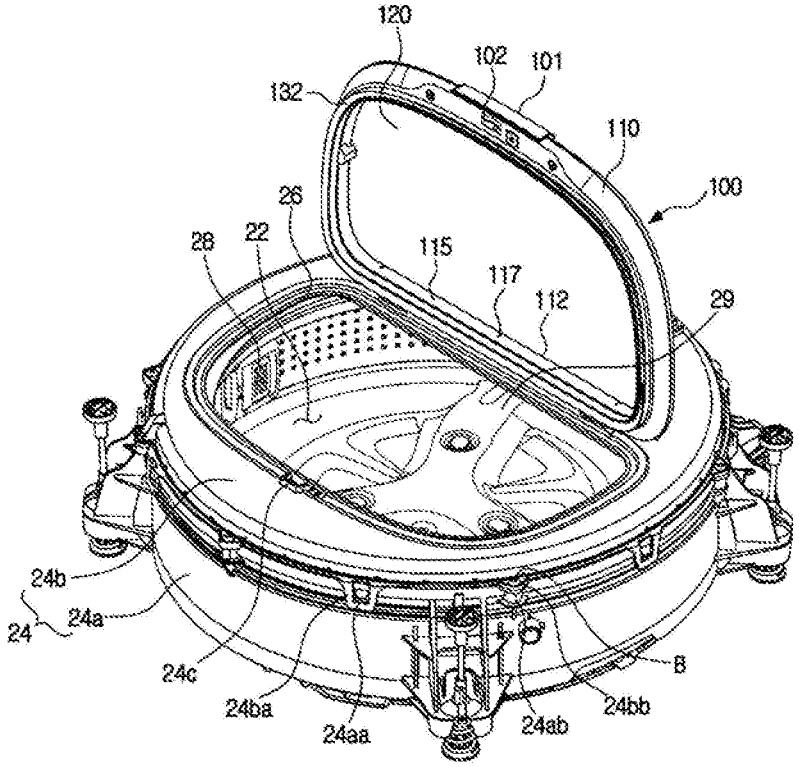
FIG. 5 is a view illustrating a state in which the second door illustrated in FIG. 4 is opened.
Figure 6:
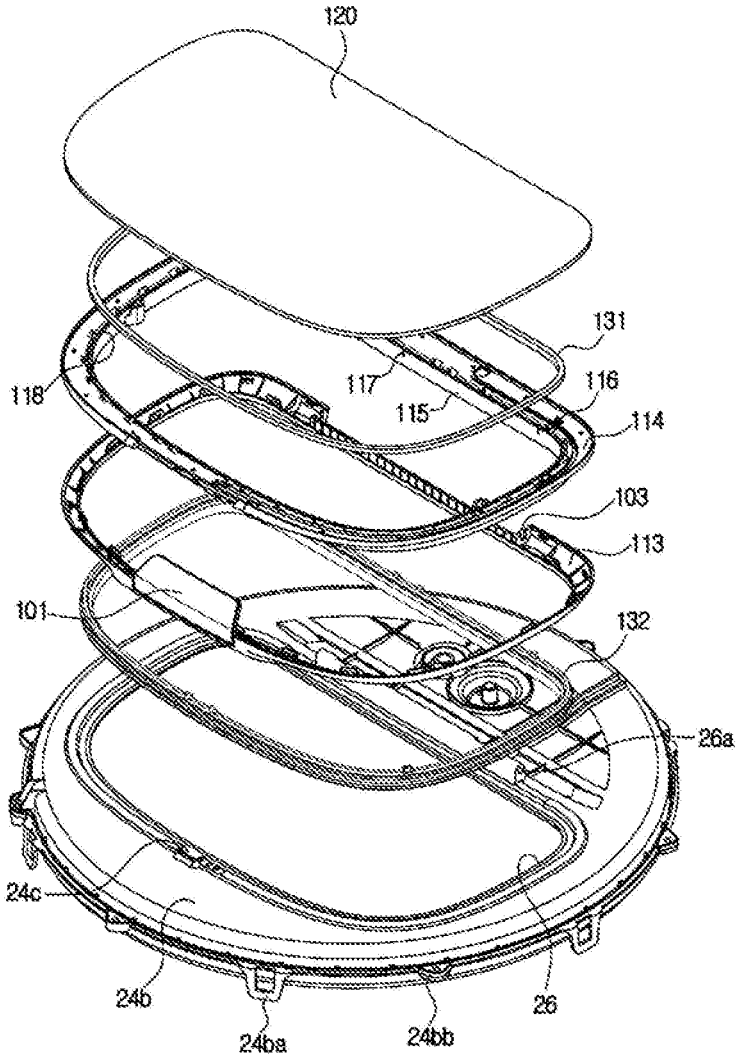
FIG. 6 is an exploded view of a tub cover and the second door illustrated in FIG. 4.
Figure 7:
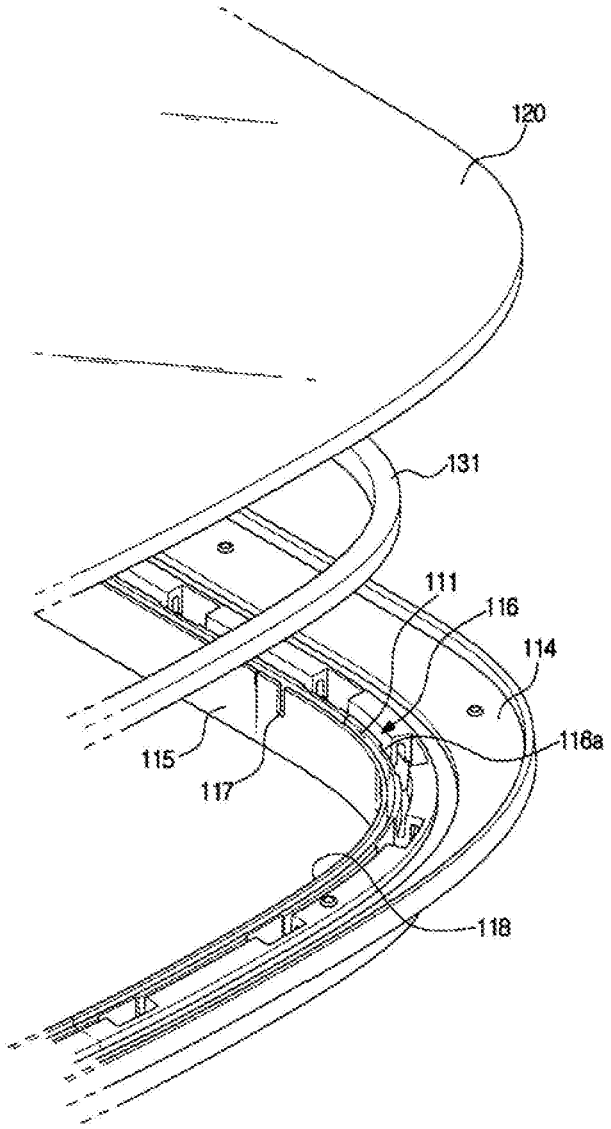
FIG. 7 is a view illustrating a process of coupling a second door cover, a first sealing member, and a second door frame illustrated in FIG. 6.

FIG. 4 is a view illustrating the second tub 24 and the second door 100 of the washing machine 1 illustrated in FIG. 1. FIG. 5 is a view illustrating a state in which the second door 100 illustrated in FIG. 4 is opened. FIG. 6 is an exploded view of a tub cover 24*b* and the second door 100 illustrated in FIG. 4. FIG. 7 is a view illustrating a process of coupling a second door cover 120, a first sealing member 106, and a second door frame 110 illustrated in FIG. 6.

The second tub 24 may include a tub body 24*a* and the tub cover 24*b*. The tub body 24*a* may be formed in a cylindrical shape with an open upper portion. The tub cover 24*b* may cover the open upper portion of the tub body 24*a*. The second opening 26 may be formed on the tub cover 24*b*.

The tub body 24*a* may include at least one coupling projection 24*aa* protruding from an upper end portion of an outer surface thereof. The tub cover 24*b* may include at least one coupling portion 24*ba* protruding from a lower end portion of an outer surface thereof. As the at least one coupling projection 24*aa* is coupled to the at least one coupling portion 24*ba*, the tub cover 24*b* may be coupled to and/or fixed to the tub body 24*a*.

The tub body 24*a* may include at least one screw coupling portion 24*ab* protruding from the upper end portion of the outer surface thereof. The tub cover 24*b* may include at least one screw fixing portion 24*bb* protruding from the lower end portion of the outer surface thereof. As a threaded screw member B passes through the at least one screw fixing portion 24*bb* and the at least one screw coupling portion 24*ab*, the tub cover 24*b* may be further firmly fixed to the tub body 24*a*.

Unlike the above, the tub body 24*a* and the tub cover 24*b* may be integrally formed.

The second door 100 may include the second door frame 110 and the second door cover 120. The second door 100 may be provided to open and close the second opening 26 of the second tub 24.

The second door frame 110 may include a first frame 114 and a second frame 113 for covering a portion of a lower end portion of the first frame 114. Alternatively, the second door frame 110 may be integrally formed.

The second door frame 110 may be rotatably mounted to the tub cover 24*b* of the second tub 24. A third hinge 26*a* may be provided around the second opening 26 so that the second door 100 may be rotated with respect to the second tub 24. The third hinge 26*a* may be coupled to a third hinge coupling portion 103 formed at one side of the second door frame 110.

A door handle 101 for opening the second door 100 may be provided on the other side opposite to the one side of the second door frame 110 on which the third hinge coupling portion 103 is formed. A second hook 102 may be provided on the door handle 101. A second hook receiving portion 24*c* is provided on the second tub 24 to correspond to the second hook 102. Accordingly, the second door 100 may be maintained in a state of closing the second opening 26.

When the door handle 101 is pulled out, the second hook 102 is detached from the second hook receiving portion 24*c*. Accordingly, the second door 100 may completely open the second washing space 22.

The second door frame 110 may include a door hole 118 provided such that the inside of the second tub 24 may be seen when the second door 100 closes the second opening 26. The door hole 118 may be formed to penetrate the inside and the outside of the second tub 24.

The second door frame 110 may include an insertion portion 116 into which at least a portion of a first sealing member 131, which will be described later, is inserted. The insertion portion 116 may be formed along a circumference of the door hole 118.

The insertion portion 116 may include a fixing portion 116*a* for fixing the first sealing member 131. The fixing portion 116*a* may be continuously formed along the circumferential direction of the door hole 118. A plurality of protrusions may be intermittently disposed in the fixing portion 116*a* along the circumferential direction of the door hole 118. A plurality of protrusions may be intermittently disposed on the fixing portion 116*a* along the circumferential direction of the door hole 118. The fixing portion 116*a* may be inserted into an insertion groove 131*a* of the first sealing member 131. Accordingly, the first sealing member 131 may be fixed to the second door frame 110.

The second door frame 110 may include a water collecting space 111 for collecting water flowing along one surface of the second door 100 when the second door 100 opens the second opening 26, and a water collecting cover portion 115 for covering at least a part of the water collecting space 111.

Specifically, the second washing apparatus 20 forms a water flow inside the second tub 24 in the process of washing the laundry. By this water flow, a part of the washing water adheres to the inner surface of the second door 100. The washing water adhered to the inner side surface of the second door 100 flows in the direction of gravity along the inner surface of the second door 100 when the second door 100 is opened after washing is completed.

In order to prevent the washing water flowing in the direction of gravity from falling into the laundry that has been washed in the second washing space 22 and wetting the washed laundry again, the second door frame 110 may include the water collecting space 111.

The water collecting space 111 may be disposed at one end of the second door frame 110 adjacent to a pivot axis with respect to the second tub 24. The water collecting space 111 may be provided to be positioned at a lower end portion of the second door 100 when the second door 100 opens the second opening 26 in order to collect water flowing in the direction of gravity along the inner surface of the second door 100. The water collecting space 111 may be formed in the insertion portion 116 of the second door frame 110.

The water collecting space 111 may be in communication with the outside through an inflow gap 112. Water existing on an inner side surface of the second door cover 120 may move downward by gravity when the second door 100 is opened, and then may flow into the water collecting space 111 through the inflow gap 112.

The inflow gap 112 may be formed between the second door cover 120 and the water collecting cover portion 115, which will be described later. The inflow gap 112 may guide water to the water collecting space 111. The inflow gap 112 may be formed as the water collecting cover portion 115 is provided to be spaced apart from one side surface of the second door cover 120. That is, the inflow gap 112 may be formed as the second door cover 120 is assembled with the second door frame 110 in a state in which a portion of the second door frame 110 on which the water collecting cover portion 115 is provided is spaced apart from the second door cover 120 by a predetermined distance.

The water collecting cover portion 115 may be disposed at at least a portion of the door hole 118 along the circumference of the door hole 118. The water collecting cover portion 115 may be spaced apart from a portion of the second door cover 120 by a predetermined distance to form the inflow gap 112 between water collecting cover portion 115 and the second door cover 120. The water collecting cover portion 115 may be disposed to be spaced apart from the inner surface of the second door cover 120 by a predetermined distance.

When the washing water collected in the water collecting space 111 is exposed to the user, the user may feel uncomfortable looking at the washing water. In order to prevent this, the water collecting cover portion 115 may be formed to cover an upper portion of the water collecting space 111 when the second door 100 opens the second opening 26. Accordingly, the washing water collected in the water collecting space 111 is not exposed to the user, so that it is possible to prevent the user from seeing the exposed washing water.

The water collecting cover portion 115 may include a drain hole 117 formed to discharge the water collected in the water collecting space 111 from the water collecting space 111 when the second door 100 closes the second opening 26. The drain hole 117 may guide the water collected in the water collecting space 111 to the inside of the second tub 24. The water collecting space 111 may be in communication with the outside through the drain hole 117.

One or more of the drain holes 117 may be provided along the circumference of the door hole 118. The drain hole 117 may be formed to penetrate the water collecting cover portion 115. The drain hole 117 may be disposed to be positioned in the front of the water collecting space 111 when the second door 100 closes the second opening 26. According to this configuration, the washing machine 1 according to the embodiment of the present disclosure may discharge the water collected in the water collecting space 111 to the second washing space 22 only by an operation closing the second door 100.

The second door cover 120 may be mounted to the second door frame 110. The second door cover 120 may be configured to include a transparent material so that the inside of the second drum 23 may be seen from the outside of the second tub 24 through the door hole 118 even when the second door 100 closes the second opening 26. The second door cover 120 may be configured to include a material having transparency. The second door cover 120 may be configured to include glass.

The second door cover 120 may be fixed to the second door frame 110 through an adhesive. In this case, the adhesive may be composed of a material capable of sealing a gap between the second door cover 120 and the second door frame 110.

Alternatively, the second door 100 of the washing machine 1 may further include the first sealing member 131 for sealing the gap between the second door cover 120 and the second door frame 110. The first sealing member 131 may be disposed along an outer circumference of the door hole 118. The first sealing member 131 may prevent the washing water in the second tub 24 from flowing out to the outside during the washing process. In addition, the first sealing member 131 may prevent the wet steam from flowing out when the second washing apparatus 20 performs washing using high-temperature washing water.

The first sealing member 131 may include the insertion groove **131*a*. The insertion groove 131*a* may be formed on one side surface of the first sealing member 131 directing to the second door frame 110. The fixing portion 116*a* of the second door frame 110 may be inserted into the insertion groove 131*a*. A portion of the first sealing member 131 may be disposed in the water collecting space 111**.

The other side surface different from one side surface of the first sealing member 131 formed with the insertion groove **131*a* may be fixed to the second door cover 120. The other side surface of the first sealing member 131 may be fixed to the second door cover 120 through an adhesive. The upper surface of the first sealing member 131 may be in surface contact with the lower surface of the second door cover 120**.

According to this configuration, the first sealing member 131 may seal the gap between the second door frame 110 and the second door cover 120. In addition, because the first sealing member 131 is inserted into the insertion portion 116 of the second door frame 110, the first sealing member 131 is not exposed to the user when the second door 100 is opened, thereby making the appearance of the second door 100 neat.

The second door 100 may further include a second sealing member 132 for sealing a gap formed between the second tub 24 and the second door 100. The second sealing member 132 may seal a gap formed between the second tub cover **24*b* and the second door 100**. The second sealing member 132 may be inserted into a fixing groove 114*a* formed in the first frame 114 of the second door frame 110. The second sealing member 132 may be disposed at a lower end portion of the second door frame 110. The second sealing member 132 may prevent the washing water in the second tub 24 from leaking to the outside during the washing process. In addition, the second sealing member 132 may prevent wet steam from flowing out when the second washing apparatus 20 performs washing with high-temperature washing water.

Figure 8:
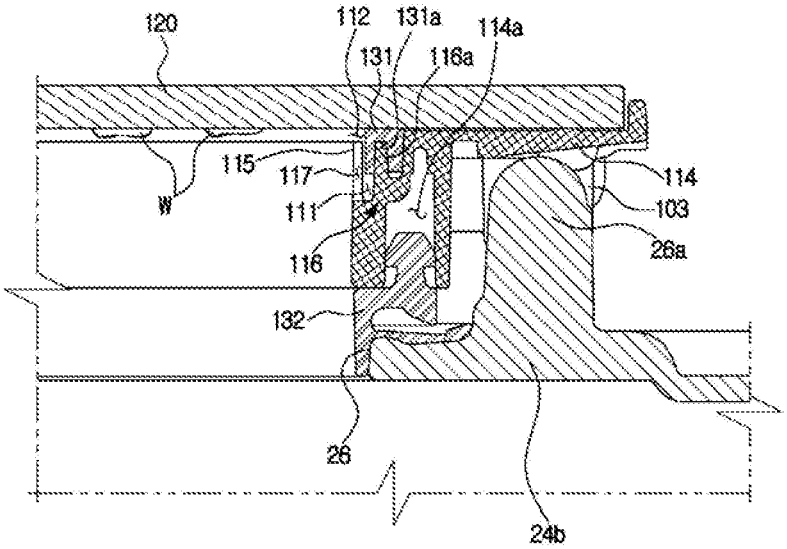
FIG. 8 is a side cross-sectional view illustrating the second tub, the second door, and a state of washing water remaining in the second door illustrated in FIG. 4 after washing is completed and before the second door illustrated in FIG. 4 is opened.
Figure 9:
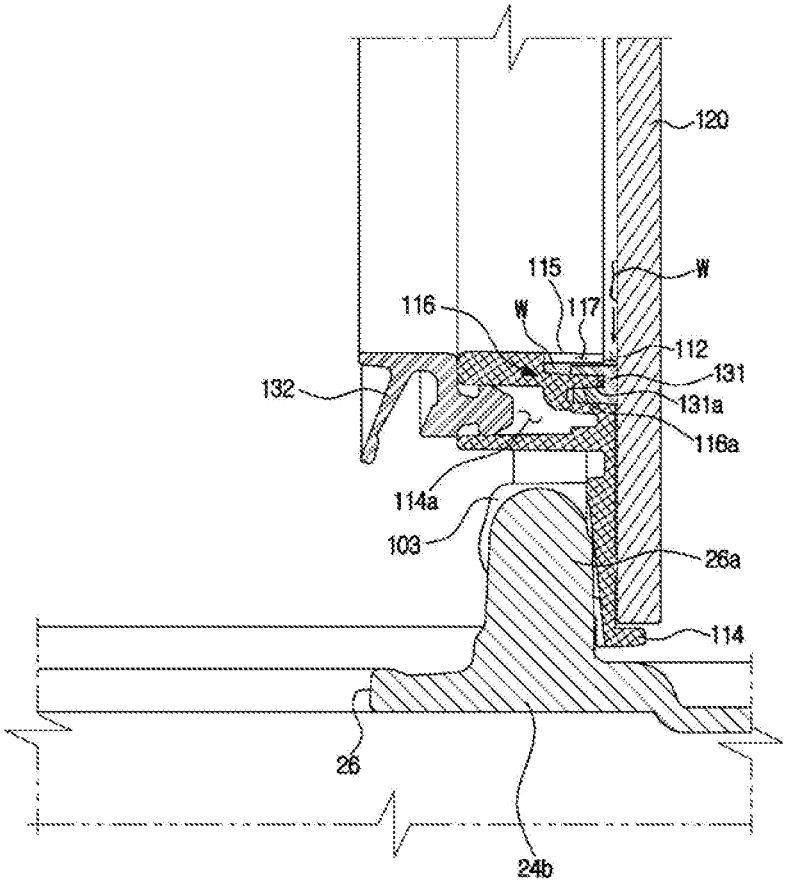
FIG. 9 is a view illustrating the flow of the washing water remaining in the second door when the second door illustrated in FIG. 8 is opened.
Figure 10:
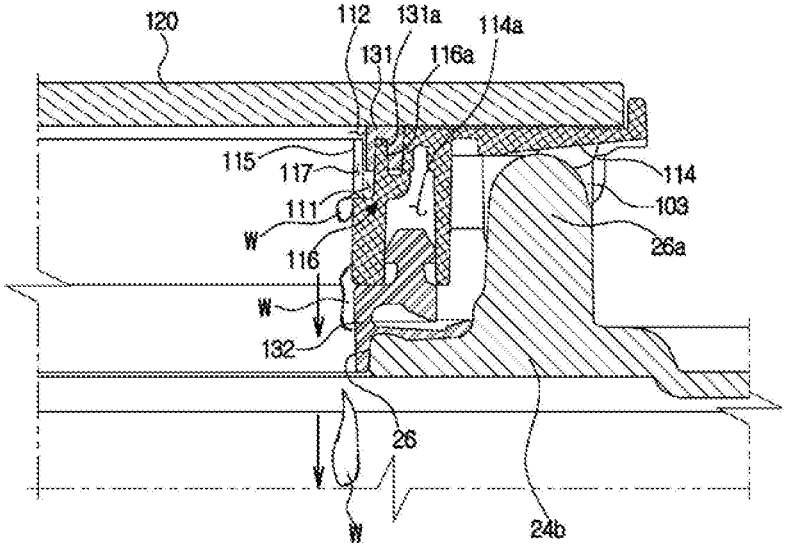
FIG. 10 is a view illustrating the flow of the washing water existing in a water collecting space when the second door illustrated in FIG. 9 is closed.

FIG. 8 is a side cross-sectional view illustrating the second tub 24, the second door 100, and a state of washing water W remaining in the second door 100 illustrated in FIG. 4 after washing is completed and before the second door 100 illustrated in FIG. 4 is opened. FIG. 9 is a view illustrating the flow of the washing water W remaining in the second door 100 when the second door 100 illustrated in FIG. 8 is opened. FIG. 10 is a view illustrating the flow of the washing water W present in the water collecting space 111 when the second door 100 illustrated in FIG. 9 is closed.

Referring to FIG. 8, when the second washing apparatus 20 completes washing, the washing water is present on the inner side surface of the second door cover 120 of the second door 100. Because the washing machine 1 according to the embodiment of the present disclosure has a plurality of washing apparatuses, in a case where the height of the top loading type washing apparatus is low, more washing water may be present on the inner side surface of the second door cover 120.

As illustrated in FIG. 9, when the user opens the second door 100 to take out the washed laundry from the second tub 24, the washing water existing on the inner side surface of the second door cover 120 of the second door 100 moves in the direction of gravity along the inner surface of the second door cover 120. The washing water moving downward may be collected in the water collecting space 111 through the inflow gap 112. The collected washing water is not exposed to the outside by the water collecting cover portion 115. In addition, the washing machine according to the embodiment of the present disclosure may prevent the laundry from being wet, which is generated by dropping the washing water existing on the inner side surface of the second door 100 to the washed laundry.

As illustrated in FIG. 10, when the user puts new laundry and closes the second door 100, water existing in the water collecting space 111 moves inside the second tub 24 through the drain hole 117. Similarly, when the user simply closes the second door 100 without putting new laundry, water existing in the water collecting space 111 moves inside the second tub 24 through the drain hole 117. That is, the washing machine 1 according to the embodiment of the present disclosure may discharge the water in the water collecting space 111 to the second washing space 22 even if the user does not separately remove the water in the water collecting space 111.

Figure 11:
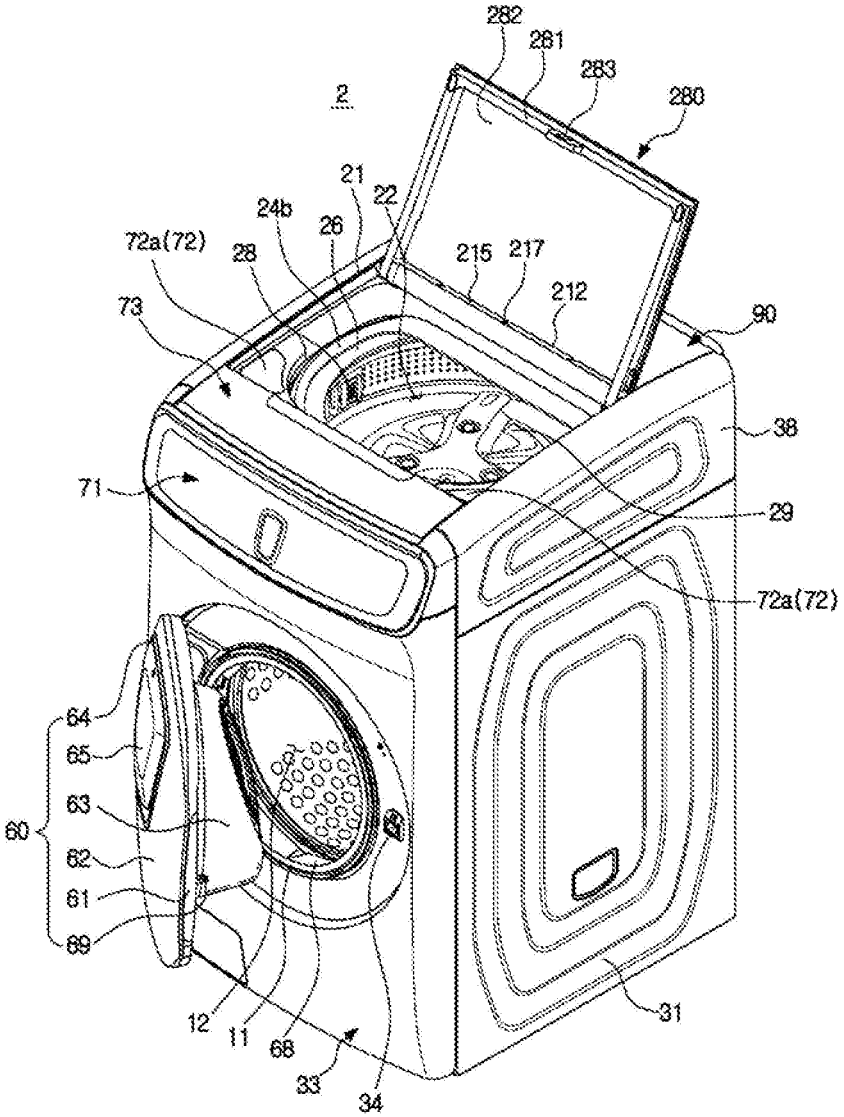
FIG. 11 is a perspective view of a washing machine according to another embodiment of the present disclosure.

FIG. 11 is a perspective view of a washing machine 2 according to another embodiment of the present disclosure.

The washing machine 2 according to another embodiment of the present disclosure will be described with reference to FIG. 11. The same components as those in the above-described embodiment may be denoted by the same reference numerals and description thereof may be omitted.

The washing machine 2 according to another embodiment of the present disclosure may not include the second door 100 unlike the embodiment described with reference to FIGS. 1 to 10.

In the washing machine 2 according to the embodiment illustrated in FIG. 11, washing water may exist in a lid 280 for opening and closing the second laundry loading port 21. The lid 280 may have a water collecting space (not shown) for collecting washing water existing on an inner side surface of the lid 280.

The lid 280 may include a lid frame 281 and a lid cover 282. A latch receiving portion 283 may be provided at a front end portion of the lid frame 281, and an upper frame (not shown) may be provided with a latch device corresponding to the latch receiving portion 283 of the lid frame 281. The lid cover 282 may be configured to include a transparent material so that the second washing space 22 may be seen from the outside of the washing machine 2.

The lid 280 may include a water collecting cover portion 215 covering the water collecting space. The water collecting cover portion 215 may be disposed to be spaced apart from an inner side surface of the lid cover 282 by a predetermined distance. An inflow gap 212 may be formed between the water collecting cover portion 215 and the lid cover 282. The water collecting cover portion 215 may include a drain hole 217 for discharging the washing water collected in the water collecting space to the second washing space 22 when the lid 280 is closed.

According to this configuration, the washing machine 2 according to the embodiment of the present disclosure illustrated in FIG. 11 may prevent the laundry from being wet, which is generated by dropping the washing water existing in the lid 280 to the washed laundry.

Figure 12:
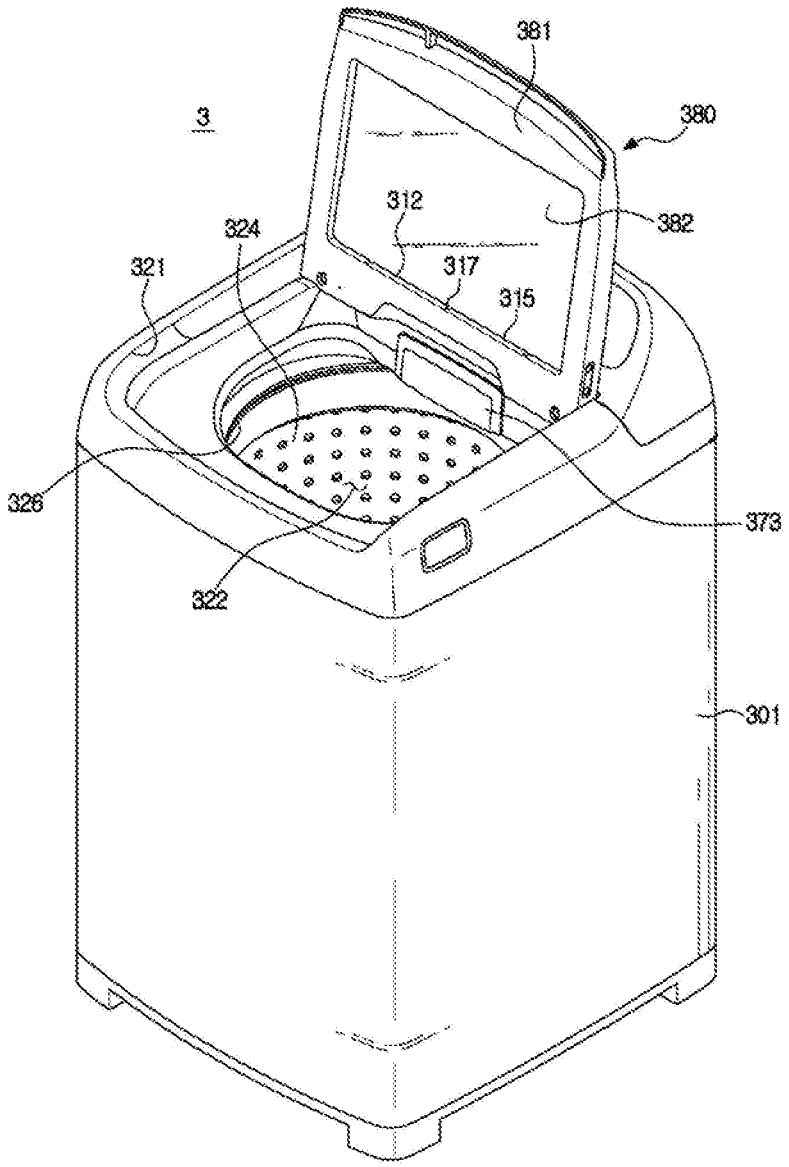
FIG. 12 is a perspective view of a washing machine according to another embodiment of the present disclosure.

FIG. 12 is a perspective view of a washing machine 3 according to another embodiment of the present disclosure.

The washing machine 3 according to another embodiment of the present disclosure will be described with reference to FIG. 12. The same components as those in the above-described embodiment may be denoted by the same reference numerals and description thereof may be omitted.

The washing machine 3 according to another embodiment of the present disclosure includes only the top loading type washing apparatus.

The washing machine 3 according to the embodiment illustrated in FIG. 12 includes a housing 301. A tub (not shown) and a drum 324 that form a washing space 322 are disposed in the housing 301. The drum 324 includes an opening 326 formed in an upward direction. The housing 301 includes a laundry loading port 321 formed in the upward direction.

A lid 380 may open and close the laundry loading port 321. The lid 380 may be rotatably provided in the housing 301. The lid 380 may include a lid frame 381 and a lid cover 382. The lid cover 382 may be configured to include a transparent material so that the washing space 322 may be seen from the outside of the housing 301.

Washing water may exist in the lid 380 for opening and closing the laundry loading port 321. The lid 380 may have a water collecting space (not shown) for collecting the washing water existing on an inner side surface thereof.

The lid 380 may include a water collecting cover portion 315 covering the water collecting space. The water collecting cover portion 315 may be disposed to be spaced apart from an inner side surface of the lid cover 382 by a predetermined distance. An inflow gap 312 may be formed between the water collecting cover portion 315 and the lid cover 382. The water collecting cover portion 315 may include a drain hole 317 for discharging the washing water collected in the water collecting space to the washing space 322 when the lid 380 is closed.

According to this configuration, the washing machine 3 according to the embodiment of the present disclosure illustrated in FIG. 12 may prevent the laundry from being wet, which is generated by dropping the washing water existing in the lid 380 to the washed laundry.

In the above, specific embodiments have been illustrated and described. However, the present disclosure is not limited to the above embodiments, and it will be apparent to those skilled in the art that various modifications and variations may be made from the present disclosure without departing from the spirit and scope of the present disclosure.

The invention claimed is:

1. A washing machine comprising:

a housing;

a tub disposed inside the housing and having a laundry loading port opening upwards; and a door provided on an upper portion of the housing to open and close the laundry loading port, wherein the door includes:

a door cover configured to include a material having transparency;

a cover holder on which the door cover is mounted, the cover holder arranged along a circumference of the door cover;

a water collecting space provided on the cover holder to collect water flowing along one surface of the door when the laundry loading port is opened; and a water collecting cover portion provided on the cover holder to cover at least a portion of the water collecting space, wherein the water collecting cover portion includes a drain hole arranged in front of the water collecting space to discharge the water collected in the water collecting space from the water collecting space when the door closes the laundry loading port, and arranged above the water collecting space when the door opens the laundry loading port.

2. The washing machine according to claim 1, wherein a portion of the door cover is spaced apart from the water collecting cover portion by a predetermined distance to form an inflow gap such that the water flows into the water collecting space.

3. The washing machine according to claim 2, wherein the door further includes a cover sealing member to seal a gap between the door cover and the cover holder, and the cover holder includes an insertion portion into which at least a portion of the cover sealing member is inserted.

4. The washing machine according to claim 3, wherein the water collecting space is formed in the insertion portion.

5. The washing machine according to claim 3, wherein the insertion portion includes a first fixing portion to fix the cover sealing member, and the cover sealing member includes a first insertion groove inserted around the first fixing portion.

6. The washing machine according to claim 5, wherein another side surface different from one side surface of the cover sealing member formed with the first insertion groove is fixed to the door cover.

7. The washing machine according to claim 1, wherein the cover holder includes a door opening formed such that the inside of the tub is seen when the door closes the laundry loading port, and the water collecting cover portion is disposed at at least a portion of the door opening along a circumference of the door opening.

8. The washing machine according to claim 1, wherein the water collecting cover portion protrudes from one surface of the door to the laundry loading port when the door closes the laundry loading port.

9. The washing machine according to claim 1, wherein the door is rotatably mounted on the tub, and the water collecting space is disposed at one side end portion adjacent to a pivot axis of the door.

10. The washing machine according to claim 9, wherein the door further includes a tub sealing member to seal a gap between the tub and the door.

11. The washing machine according to claim 1, wherein the water collecting space is disposed at a lower end portion of the door when the door opens the laundry loading port.

12. The washing machine according to claim 1, further comprising a lid rotatably provided in the housing, wherein the housing includes a housing opening formed in a direction to which the laundry loading port directs, and the lid opens and closes the housing opening.

* * * * *